US010132172B2

(12) United States Patent
Berger et al.

(10) Patent No.: US 10,132,172 B2
(45) Date of Patent: Nov. 20, 2018

(54) ARRANGEMENT OF A ROTOR AND AT LEAST A BLADE

(71) Applicant: Ansaldo Energia Switzerland AG, Baden (CH)

(72) Inventors: Carl Berger, Wettingen (CH); Marco Lamminger, Ennetbaden (CH); Christoph Didion, Wettingen (CH); Cyrille Bricaud, Rheinfelden (DE); Philippe Thomas Lott, Biederthal (FR); Igor Tsypkaykin, Turgi (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 222 days.

(21) Appl. No.: 14/964,062

(22) Filed: Dec. 9, 2015

(65) Prior Publication Data

US 2016/0177750 A1 Jun. 23, 2016

(30) Foreign Application Priority Data

Dec. 17, 2014 (EP) ..... 14198451

(51) Int. Cl.

| | |
|---|---|
| ***F01D 5/30*** | (2006.01) |
| ***F01D 11/00*** | (2006.01) |
| ***F01D 5/32*** | (2006.01) |

(52) U.S. Cl.

CPC ..... *F01D 5/3015* (2013.01); *F01D 5/326* (2013.01); *F01D 11/006* (2013.01); *F05D 2220/32* (2013.01); *F05D 2240/24* (2013.01); *F05D 2260/30* (2013.01)

(58) Field of Classification Search

CPC ..... F01D 5/084; F01D 5/326; F01D 5/3015; F01D 5/087; F01D 5/081; F01D 11/006

See application file for complete search history.

(56) References Cited

U.S. PATENT DOCUMENTS

| | | | | |
|---|---|---|---|---|
| 5,800,124 | A | 9/1998 | Zelesky | |
| 6,416,282 | B1 * | 7/2002 | Beeck | F01D 5/087 415/115 |
| 2010/0196164 | A1 | 8/2010 | Liotta et al. | |
| 2011/0200448 | A1 | 8/2011 | Elliott et al. | |

(Continued)

FOREIGN PATENT DOCUMENTS

| | | |
|---|---|---|
| DE | 199 50 109 | 4/2001 |
| EP | 0 801 208 A2 | 10/1997 |

(Continued)

OTHER PUBLICATIONS

European Search Report dated Jun. 16, 2015 for Application No. 14198451.8.

*Primary Examiner* — Dwayne J White
*Assistant Examiner* — Su Htay
(74) *Attorney, Agent, or Firm* — Buchanan Ingersoll & Rooney PC

(57) ABSTRACT

It is disclosed an arrangement of a rotor and at least a blade. The blade includes a root, a platform and an airfoil. The rotor includes a seat for the root. The root has side walls which complement side walls of the seat and axial walls between the side walls. A chamber is provided between the root and the rotor. A shank cavity is provided between the root and the platform. A lock plate facing at least an axial wall is connected to the rotor and the blade. The lock plate has at least a slot on a side facing the root.

9 Claims, 3 Drawing Sheets

(56) References Cited

U.S. PATENT DOCUMENTS

| | | | |
|---|---|---|---|
| 2012/0082568 | A1 | 4/2012 | Tibbott et al. |
| 2013/0294927 | A1 | 11/2013 | Dimmick, III et al. |

FOREIGN PATENT DOCUMENTS

| | | | | | |
|---|---|---|---|---|---|
| EP | 2 216 505 | A2 | | 8/2010 | |
| EP | 2 357 321 | A2 | | 8/2011 | |
| EP | 2 436 879 | A2 | | 4/2012 | |
| EP | 2 662 533 | A2 | | 11/2013 | |
| FR | 2 969 209 | A1 | | 6/2012 | |
| GB | 2 194 000 | A | | 2/1988 | |
| GB | 2 435 909 | A | | 9/2007 | |
| GB | 2435909 | A | * | 9/2007 | ..... F01D 5/081 |

* cited by examiner

ARRANGEMENT OF A ROTOR AND AT LEAST A BLADE

TECHNICAL FIELD

The present invention relates to an arrangement of a rotor and at least a blade. The rotor and the at least a blade are part of a gas turbine engine.

BACKGROUND

Gas turbines engines typically comprise a compressor for an oxidizer such as air, a combustion chamber for combusting the compressed air with a fuel generating hot gas and a turbine for expanding the hot gas and collecting mechanical work.

The turbine in particular has a duct and vanes extending from the casing into the duct and blades extending from a rotor into the duct.

In order to connect the blades to the rotor, the rotor has seats and the blades have roots (usually shaped like fir trees) that are connected into the seats to radially fix the blade position. In addition, in order to fix the axial position of the blades, lock plates are provided connected to both the rotor and the blade.

Since the roots undergo high stress and can be subject to high temperature, for example due to leakages of hot gas from the duct, the roots (but also other rotor and blade parts close to the roots) need to be cooled. For this reason, a chamber is usually provided between the roots and the rotor (i.e. below the roots) and, in addition, a shank cavity is provided between the roots and blade platforms (i.e. above the blade roots).

Cooling air is then typically supplied into each chamber via a cooling channel of the rotor, and from the chamber cooling air is supplied into each shank cavity via passages indented in the sides of the roots, i.e. in the parts of the blades that connect the blades to the rotor.

For this reason the connection surface between the roots and the rotor is reduced; this can cause increased stress in the roots. In addition, since often the cooling channel is indented in terminal parts of the connection surface, stress of the root can be non-uniform over the connection surface axial length. Moreover, since the passages for supplying cooling air from the chamber into the shank cavity have strict constrains deriving from the fact that they are indented in the roots, their configuration could not be optimized for cooling, such that heat removal could, be non-optimal.

SUMMARY

An aspect of the invention includes providing an arrangement of a rotor and at least a blade in which the stress distribution in the root is optimized.

Another aspect of the invention includes providing an arrangement of a rotor and at least a blade in which the heat removal from around the blade root can be optimized.

These and further aspects are attained by providing an arrangement of a rotor and at least a blade in accordance with the accompanying claims.

Advantageously, cooling the root can be decoupled from the mechanical constrains of the root.

BRIEF DESCRIPTION OF THE DRAWINGS

Further characteristics and advantages will be more apparent from the description of a preferred but non-exclusive embodiment of the arrangement, illustrated by way of non-limiting example in the accompanying drawings, in which:

1 schematically shows a gas turbine engine,

Figure 1:
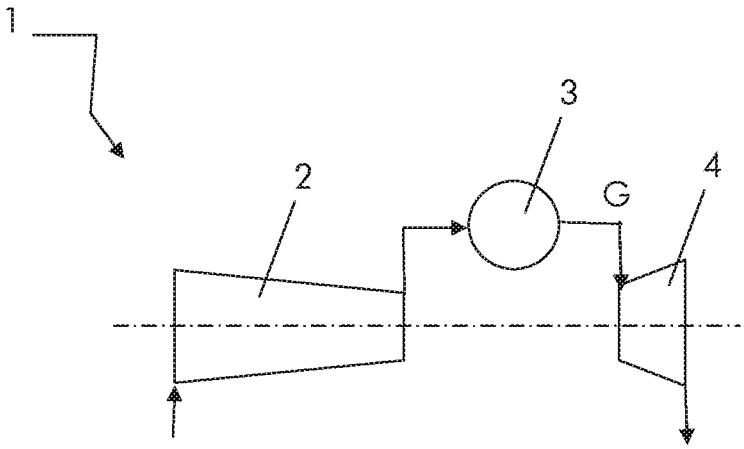
Figure 2:
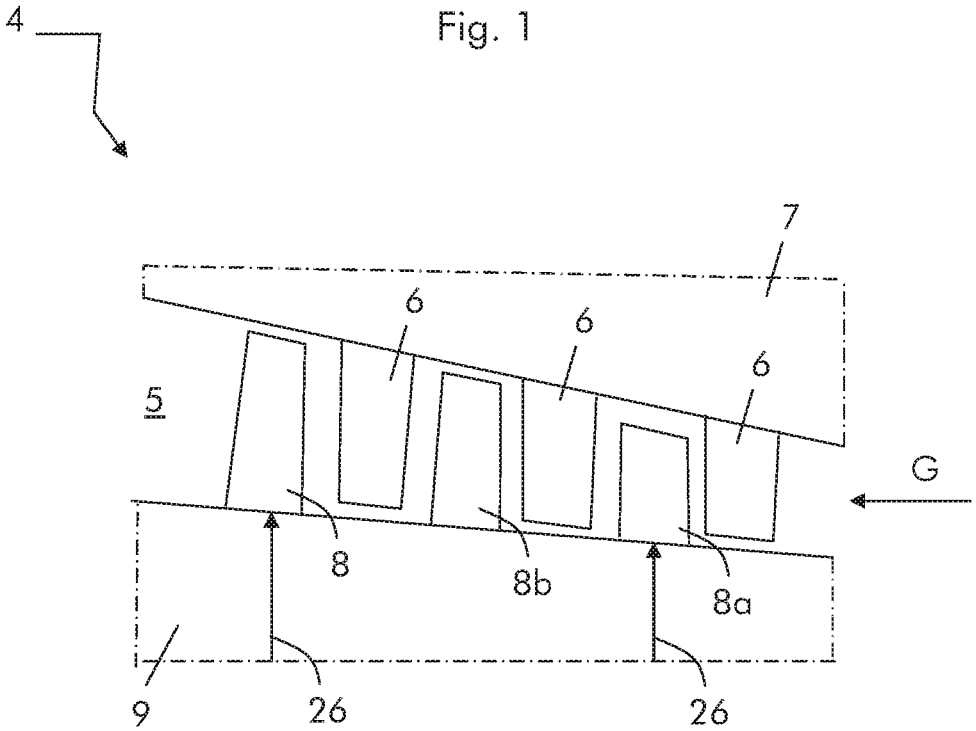
Figure 3:
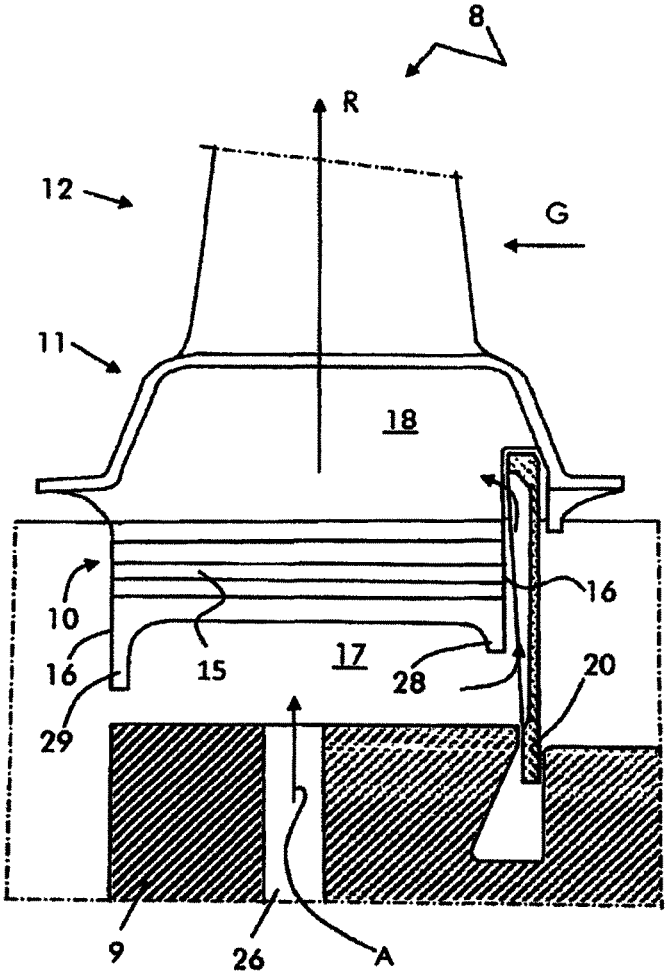
Figure 4:
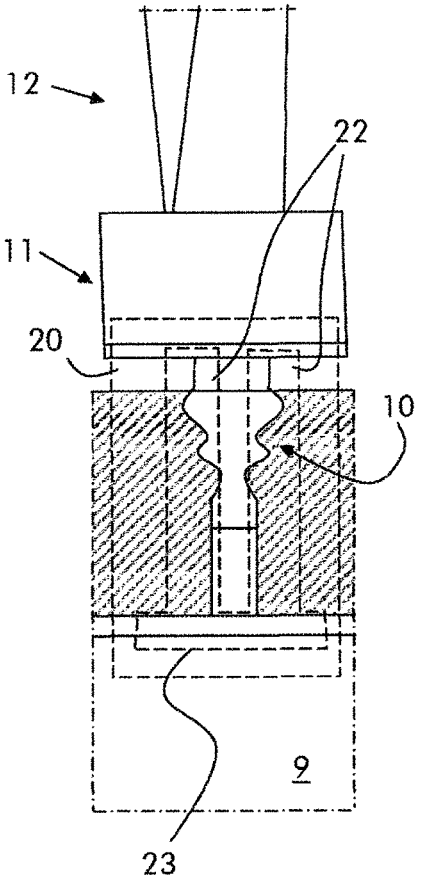
Figure 5:
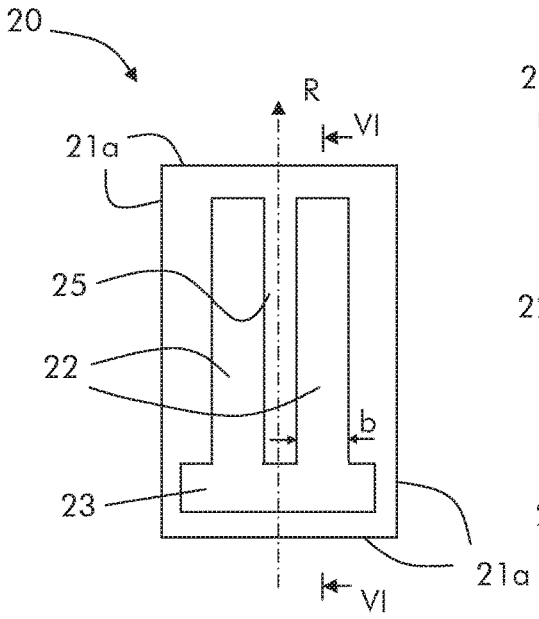
Figure 6:
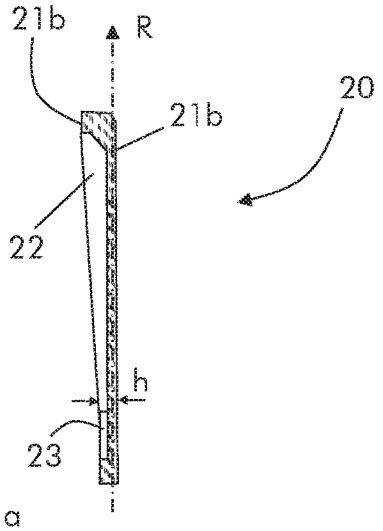
Figure 7:
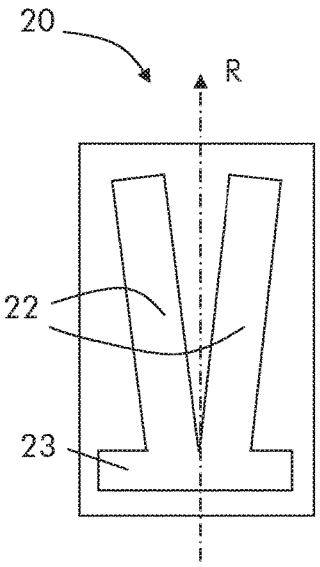
Figure 8:
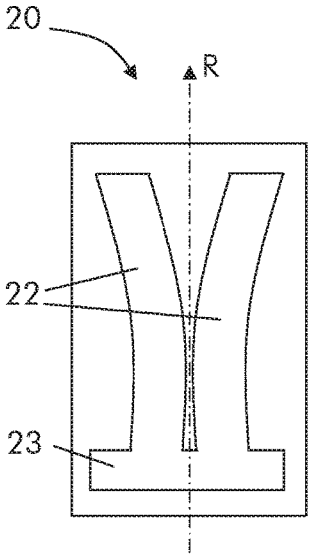
Figure 9:
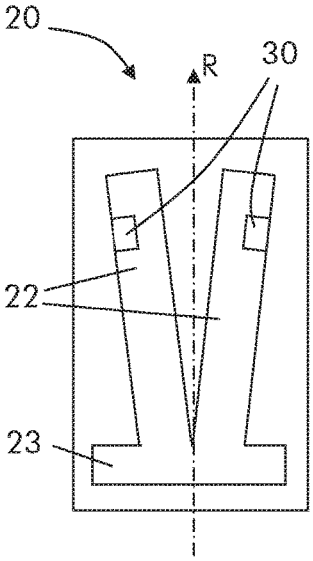

2 schematically shows a duct with vanes and blades,

FIGS. 3 and 4 schematically show a blade,

FIGS. 5 and 6 schematically show a front view and a cross section over line VI-VI of an embodiment of a lock plate, and FIGS. 7 through 9 schematically show different embodiments of a lock plate.

DETAILED DESCRIPTION OF EXEMPLARY EMBODIMENTS

With reference to the figures, these show a gas turbine engine 1 having a compressor 2 for an oxidizer such as air, a combustion chamber 3 where a fuel is combusted with the compressed oxidizer generating hot gas G and a turbine 4 where the hot gas is expanded to gather mechanical work on a gas turbine rotor.

The turbine 4 has a duct 5 (usually with an annular shape) into which vanes 6 extend from a casing 7 and blades 8, 8*a*, 8*b* extend from a rotor 9.

The rotor 9 carries a plurality of blades of different stages. For example 2 shows the blades 8*a*, 8*b*, 8 of three stages next to one another.

FIGS. 3 and 4 show a blade 8. The blade 8 has a root 10, typically shaped like a fir tree, a platform 11 connected to the root 10 and an airfoil 12 extending from the platform.

The rotor 9 includes seats for the roots 10 of the blade 8. In particular, the root 10 has side walls 15 which complement side walls of the seat and axial walls 16 between the side walls 15.

When the blades 8 are connected in the seats, chambers 17 are provided between the root 10 and the rotor 9 (i.e. below the root); in addition shank cavities 18 are provided between the root 10 and the platform 11.

Further, lock plates 20 facing an axial wall 16 (preferably the axial wall 16 facing the compressor 2) are connected to the rotor 9 and the blade 8. The lock plates 20 have borders 21*a* and opposite sides 21*b*.

With this connection the root 10 (with its fir tree configuration) radially block the blade 8 and the lock plate 20 axially block the blade 8; the blade 8 is thus fixed to the rotor 9.

The lock plate 20 has one or more slots 22 on its side 21*b* facing the root 10 of the blade 8 it is connected to. The slots 22 extend in a substantially radial direction (the axis R identifies the radial axis of the turbine 4); substantially radial direction is not to be intended in a limitative way but the slots can also depart from a strict radial direction but generally develop over a radial direction (see for example FIGS. 7 and 8).

For example, FIGS. 5 and 6 show a lock plate 20 having two slots 22, any other number of slots 22 is anyhow possible according to the needs.

Preferably at least one slot 22 faces a root 10; this helps cooling the root and removing possible hot gas leakages from a zone around the root.

In addition, in a preferred embodiment, at least some of the plurality of slots 22 are connected together, for example via a cut out 23. In this case the cut out 23 preferably faces at least partly the chamber 17; this helps cooling air entrance from the chamber 17 into the cut out 23 and slots 22.

Between the slots 22 there are defined ribs 25. These ribs increase rigidity of the lock plate 20 and help preventing lock plate bending caused by the centrifugal forces.

Still with reference to FIGS. 3 and 4, the rotor 9 has cooling channels 26 that open in each chamber 17 and the root 10 has a protrusion 28 facing the lock plate 20. The protrusion 28 defines the chamber 17 opening facing the lock plate 20, in order to pre-define the cooling air that passes from the chamber 17 into the cut out 23 and slots 22. Another possibility to control the cooling air flow is the adjustment of the height h or the width b of the slots 22; a further alternative solution is also a local restriction 30 of the slots 22. Naturally all these ways of controlling the cooling air flow can be combined one another.

Likewise, the opposite end of the root 10 can also have a protrusion 29 facing away from the lock plate 20 in order to pre-define the cooling air that moves out of the chamber 17. For example this air moving out from the chamber 17 via the opening defined by the protrusion 29 is forwarded to other blades for their cooling. For example, with reference to 2, the blade 8*a* is connected to a cooling channel 26 whereas the blade 8*b* is not connected to any cooling channel similar to the cooling channel 26; in this case the blade 8*b* is cooled by the cooling air coming from the blade 8*a* via the opening defined by the protrusion 29.

Each of the protrusions 28 and 29 extends preferably radially, anyhow one or both the protrusions 28, 29 can also extend axially or radially/axially.

The operation of the arrangement is apparent from that described and illustrated and is substantially the following.

Hot gas G generated in the combustion chamber passes through the duct 5 and expands, while transferring mechanical power to the blades 8 and thus to the rotor 9.

With reference to 3, during operation cooling air A enters the chamber 17 via the cooling channel 26. From the chamber 17 the cooling air A enters the slots 22 (possibly via the cut out 23 when provided) and enters the shank cavity 18, cooling it.

In addition, cooling air moves out of the cavity 17 passing the projection 29 and moving towards other use, such as for example cooling of other blades.

Since passages for forwarding cooling air from the chambers 17 into the shank cavities 18 are not provided (or at least have a small extension) on the side walls 15 of the roots 10 but are defined by the slots 22 of the lock plates 20, stress distribution of the roots can be optimized and reduced.

In addition, since the slots 22 for cooling the roots 10 and the area around are indented in the lock plates 20, the configuration of the slots 22 can be selected according to the cooling needed at the roots 10 and possibly at the shank cavities 18 (but usually cooling at the shank cavities 18 is less burdensome than cooling of the roots 10 and is usually not troubling). Moreover, since cooling air passes between the roots 10 and the lock plates 20, possible leakages of hot gas that could overcome the lock plates 20 and reach the roots 10 are diluted by the cooling air and drawn away from the roots 10 into the shank cavities 18.

Naturally the features described may be independently provided from one another.

In practice the materials used and the dimensions can be chosen at will according to requirements and to the state of the art.

REFERENCE NUMBERS

1 gas turbine engine
2 compressor
3 combustion chamber
4 turbine
5 duct
6 vane
7 casing
8, 8*a*, 8*b* blade
9 rotor
10 root
11 platform
12 airfoil
15 side wall
16 axial wall
17 chamber
18 shank cavity
20 lock plate
22 slot
23 cut out
25 rib
26 cooling channel
28 protrusion
29 protrusion
30 local restriction
b height of the slot
h width of the slot
A cooling air
G hot gas
R radial axis

The invention claimed is:

1. An arrangement of a rotor and at least a blade, comprising:

a blade which includes a root, a platform and an airfoil; and a rotor which includes a seat for the root, the root having side walls which complement side walls of the seat, and having axial walls between the side walls;

a chamber between the root and the rotor;

a shank cavity between the root and the platform; and a lock plate facing one axial wall of the axial walls and being connected to the rotor and the blade, wherein the lock plate has a plurality of slots on a side facing the root wherein at least some of the plurality of slots are connected together via a cut out configured to feed cooling air to the slots.

2. The arrangement of claim 1, wherein the plurality of slots extend in a substantially radial direction of the turbine.

3. The arrangement of claim 1, wherein the cut out at least partly faces the chamber.

4. The arrangement of claim 1, comprising:

ribs defined between the slots.

5. The arrangement of claim 1, wherein the root comprises:

a protrusion that protrudes into the chamber radially.

6. The arrangement of claim 5, wherein the root comprises:

a second protrusion that protrudes into the chamber radially.

7. The arrangement of claim 1, wherein at least one slot of the plurality of slots comprises:

a local restriction for reducing air flow that passes the restriction.

8. A lock plate comprising:

borders and opposite sides, arranged and configured for fixing an axial position of a blade on a rotor of a gas turbine engine wherein at least one side of the lock plate has a plurality of slots on a side configured to face a root of a blade wherein at least some of the plurality of slots are connected together via a cut out configured to feed cooling air to the slots.

9. The lock plate of claim 8, wherein at least one slot of the plurality of slots comprises:

a local restriction for reducing air flow that passes the restriction.

* * * * *